US009451864B2

(12) United States Patent
Tempelmann et al.

(10) Patent No.: US 9,451,864 B2
(45) Date of Patent: Sep. 27, 2016

(54) FILTER

(75) Inventors: Sarah Tempelmann, Stockholm (SE); Gerhard Haider, Stockholm (SE); Niklas Nordin, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 270 days.

(21) Appl. No.: 14/114,436

(22) PCT Filed: Apr. 27, 2012

(86) PCT No.: PCT/EP2012/057815

§ 371 (c)(1),
(2), (4) Date: Feb. 11, 2014

(87) PCT Pub. No.: WO2012/146742

PCT Pub. Date: Nov. 1, 2012

(65) Prior Publication Data

US 2014/0305474 A1 Oct. 16, 2014

(30) Foreign Application Priority Data

Apr. 29, 2011 (EP) ..... 11164287

(51) Int. Cl.
*A47L 15/42* (2006.01)

(52) U.S. Cl.
CPC ..... *A47L 15/4202* (2013.01); *A47L 15/4204* (2013.01); *A47L 15/4246* (2013.01)

(58) Field of Classification Search
CPC ..... A47L 15/4204
See application file for complete search history.

(56) References Cited

U.S. PATENT DOCUMENTS

| | | | |
|---|---|---|---|
| D197,026 | S | 12/1963 | Jellies |
| 3,233,919 | A | 2/1966 | Ullman, Jr. et al. |
| 3,322,285 | A | 5/1967 | Lopp |

(Continued)

FOREIGN PATENT DOCUMENTS

| | | |
|---|---|---|
| DE | 36 36 437 A1 | 5/1988 |
| DE | 3636437 | 5/1988 |

(Continued)

OTHER PUBLICATIONS

International Search Report and Written Opinion of the International Searching Authority dated Jun. 1, 2012 for corresponding Application No. PCT/EP2012/057815.

*Primary Examiner* — Jason Ko
(74) *Attorney, Agent, or Firm* — Alston & Bird LLP

(57) ABSTRACT

The present invention relates to a dishwasher. The dishwasher (10) comprises a washing chamber (11) and a water filtering system arranged in the lower part of the washing chamber (11). The water filtering system comprises a filter (20) and a central filter unit (30) that are removable arranged in said washing chamber (11). The filter (20) has a substantially flat shape and is supported around its outer periphery (21) by a contact surface (22) of a recess (24) in the lower part of the washing chamber (11) and is secured in the washing chamber by the central filter unit (30). The unit (30) is arranged in an opening (31) in the filter (20) and comprises a surface (35) that is pressing on the inner periphery (36) of the opening (31) in the filter (20) to secure the filter (20) in the intended position. The outer periphery (21) of the filter (20) or said contact surface (22) of the recess (24), and said surface (35) of the central filter unit (30) or the inner periphery (36) of the filter (20) extending around the opening (31) are covered by a layer (25; 39) of elastic material.

10 Claims, 4 Drawing Sheets

(56) References Cited

U.S. PATENT DOCUMENTS

| | | | |
|---|---|---|---|
| 3,335,867 | A | 8/1967 | Perl |
| 3,434,671 | A | 3/1969 | Cushing et al. |
| 3,669,132 | A | 6/1972 | Mamrose |
| 3,981,456 | A | 9/1976 | Hahn et al. |
| 4,392,891 | A | 7/1983 | Meyers |
| 4,406,326 | A | 9/1983 | Wagner |
| 5,018,372 | A | 5/1991 | Altnau, Sr. |
| 5,143,306 | A | 9/1992 | Nilsson |
| 5,165,433 | A | 11/1992 | Meyers |
| 5,333,631 | A | 8/1994 | Kirkland et al. |
| 5,377,707 | A | 1/1995 | Young, Jr. |
| 5,620,014 | A | 4/1997 | Milocco et al. |
| 6,742,531 | B2 | 6/2004 | Christman et al. |
| 7,261,111 | B2 | 8/2007 | Marettek |
| 7,409,960 | B2 | 8/2008 | Hoser et al. |
| 7,478,642 | B2 | 1/2009 | Koch et al. |
| 8,709,242 | B2 | 4/2014 | Amann et al. |
| 2008/0190464 | A1 | 8/2008 | Stahlmann et al. |
| 2010/0037923 | A1 | 2/2010 | Dingler et al. |
| 2012/0186609 | A1 | 7/2012 | Haltmayer et al. |
| 2014/0305474 | A1 | 10/2014 | Tempelmann et al. |

FOREIGN PATENT DOCUMENTS

| | | | |
|---|---|---|---|
| DE | 19756516 | A1 | 6/1999 |
| DE | 10208992 | B4 | 6/2007 |
| DE | 102010041158 | A1 | 3/2012 |
| EP | 1 340 448 | A2 | 9/2003 |
| EP | 1340448 | A2 | 9/2003 |
| EP | 2430969 | A1 | 7/2009 |
| EP | 2074921 | A2 | 3/2012 |
| GB | 2113121 | | 2/1986 |
| GB | 2382642 | | 5/2005 |
| JP | 2002325716 | | 11/2002 |

FILTER

CROSS REFERENCE TO RELATED APPLICATIONS

This application is a national stage application filed under 35 U.S.C. 371 of International Application No. PCT/EP2012/057815, filed Apr. 27, 2012, which claims priority from European Patent Application No. 11164287.2, filed Apr. 29, 2011, each of which is incorporated by reference herein in its entirety.

FIELD OF THE INVENTION

The present invention relates to a dishwasher, and a filter for use in a dishwasher.

BACKGROUND OF THE INVENTION

Dishwashers are a frequently used household machine in order to facilitate the daily work. Dirty items are placed in a washing chamber in which heated water is sprayed over the items in order to wash the different items. The water is circulated in the washing chamber by a pumping device and sprayed on the dirty items from a number of nozzles arranged on rotating arms in the washing chamber. The water flows downwards in the washing chamber and is passing through a filter system having a flat filter that is supported around its outer periphery by a supporting edge with a shape corresponding to the shape of the filter and secured in the intended position, for example by a central filter unit, before it is collected in a sump in the lower section of the washing chamber and lead to the pump. Examples of different filter arrangements of the described type are known from EP1 340 448, EP 1 424 034B1 and US2010/0037923.

In order to provide the required filter area, the flat filter has a considerable size. The filter size, and shape, makes it difficult to ensure the desired sealing between the filter outer periphery, the supporting edge in the lower section of the washing chamber and the central filter unit. In case of dirty water bypassing the filter system, the dirty water will be lead to the pump and further to the water spray nozzles that in worst case get blocked by the particles in the water. Furthermore the known filter arrangements are expensive to manufacture since the arrangements comprises several different components that must fit properly together to ensure the desired securing of the different filter system components as well as the required sealing between the different components There is consequently a need for a dishwasher, and a filter, that reduces the risk that dirty water is bypassing the filter, and is less complicated to manufacture.

SUMMARY OF THE INVENTION

The present invention, defined in the appended claims, provides a dishwasher and a filter that fulfils the needs defined above.

The dishwasher according to the invention comprises a washing chamber and a water filtering system arranged in the lower part of the washing chamber. The water filtering system comprises a filter and a central filter unit that are removable arranged in said washing chamber. The filter has a substantially flat shape and is supported around its outer periphery by a contact surface of a recess in the lower part of the washing chamber and is secured in the washing chamber by the central filter unit, said unit being arranged in an opening in the filter and comprising a surface that is pressing on the inner periphery of the opening in the filter to secure the filter in the intended position, wherein said outer periphery of the filter or said contact surface of the recess, and said surface of the central filter unit or the inner periphery of the filter extending around the opening are covered by a layer of elastic material.

The claimed invention fulfils the needs defined above by improving the sealing between the outer periphery of the filter and the recess in the lower part of the washing chamber, as well as between the opening in the filter and the central filter unit arranged in the opening. The addition of the layer of elastic sealing material on one of the surfaces in contact with each other improves the sealing between the different surfaces considerably since the elastic material makes it possible to compensate for deformations of the filter due to changing temperature and rough conditions that over time could lead to deformations of the filter. The layer of elastic material furthermore reduces the risk for water bypassing the filter in case of non-correctly positioning of the filter after the filter has been removed for cleaning. Finally the dishwasher according to the invention reduces the demands on the manufacturing tolerances of the recesses in the lower part of the washing chamber, the filter and the central filter unit since the layer of elastic material will improve the sealing between the different components and thereby the tolerances of the components could be reduced which consequently reduces the manufacturing costs for the entire filtering system considerably.

In one embodiment of the invention, the outer periphery of the filter and the inner periphery of the filter extending around the opening are shaped like substantially flat rims. This is a favourable embodiment of the filter outer and inner periphery for several reasons, first the flat rim, in combination with a substantially flat contact surface of the recess and a substantially flat surface of the central filter unit, ensures that the layer of elastic material will be in contact with the corresponding surface of the recess, the filter or the central filter unit, even though the components are not positioned in the exact position in relation to each other, which means that the desired sealing between the components will still be achieved. For the same reasons the tolerance requirements of the different components could be reduced which reduces the manufacturing costs considerably. Flat rims are also in general easier and less expensive to manufacture than other shapes, like bent or folded or curved rims. The substantially flat rims could have substantially the same width as the substantially flat contact surfaces on the recess and the central filter unit, but also other widths are possible.

In one embodiment of the invention, the flat rims of the outer periphery of the filter and the inner periphery extending around the opening are covered by the elastic material. This embodiment is very favourable since both the sealing around the outer and inner periphery could be achieved by applying the layer of elastic material on the outer and inner periphery of the filter without involving the other components of the dish washer.

In one embodiment of the invention, openings or cut-out portions are arranged in the flat rims covered by the elastic material. This embodiment increases the bounding strength between the elastic material and the flat filter that is manufactured by a metal or plastic material that are able to withstand the widely changing temperatures in the washing chamber as well as water and the detergent used in the dishwasher.

In one embodiment of the invention, the cross sectional shape of the elastic material has a shape and size such that the there are substantially no gaps between the filter and the recess or between the filter and the central filter unit. Thereby, the sealing between the filter and the recess, and between the filter and the central filter unit is improved. Also, collection of dirt and particles in gaps between the filter and the recess, and between the filter and the central filter unit, is avoided.

In one embodiment of the invention, the opening in the filter has a substantially circular shape with a diameter corresponding to the diameter of the central filter unit. This is an embodiment of the filter and filter unit that provides a reliable securing and sealing between the filter and the central filter unit.

In one embodiment of the invention, the layer of elastic material is moulded onto the outer periphery of the filter and onto the inner periphery of the opening in the filter. Thereby, a safe sealing between the layer of elastic material and the material onto which it is applied is achieved. Moulding is especially suitable in the case of flat rims.

The different embodiment described above could of course be combined in different ways without departing from the scope of the invention that will be described more in detail in the detailed description.

BRIEF DESCRIPTION OF THE DRAWINGS

One embodiment of the invention is schematically illustrated in the appended figures.

DETAILED DESCRIPTION OF EMBODIMENTS

Figure 1:
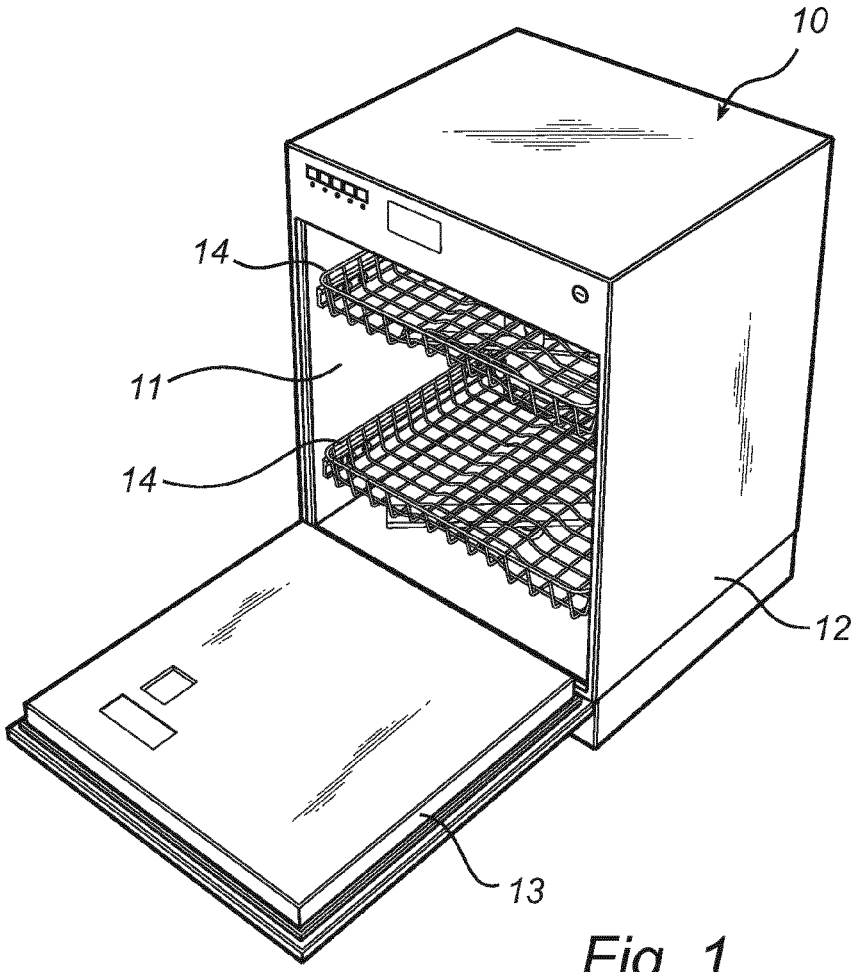
FIG. 1 illustrates a perspective view of a dishwasher.

In FIG. 1 a schematic dishwasher 10 is illustrated. The dishwasher comprises a washing chamber 11 surrounded by a cabinet 12. Between the washing chamber 11 and the cabinet 12 insulation is preferably arranged to reduce the amount of noise transmitted from the dishwasher, and reduce the temperature of the cabinet 12. The dishwasher furthermore comprises a door 13 in order to make it possible to access, and close, the washing chamber 11. In the washing chamber 11 one, or more, baskets 14 for the dirty items is arranged.

During use, heated water is circulating in the washing chamber 11 by a water circulating system in order to clean the dirty items positioned in the washing chamber. The water is sprayed on the items by nozzles arranged at different locations within the washing chamber and flowing, by gravity, to the lower part of the washing chamber that is formed as a tub 15 to collect the flowing water. In the bottom of the tub 15, a water filtering system is arranged. The object of the water filtering system is to remove dirt and particles from the used water before the water is reused and once again sprayed into the washing chamber. The filtering system improves the final washing result and ensures the function of water circulating system that otherwise would get blocked by dirt and particles in the used water.

Figure 2:
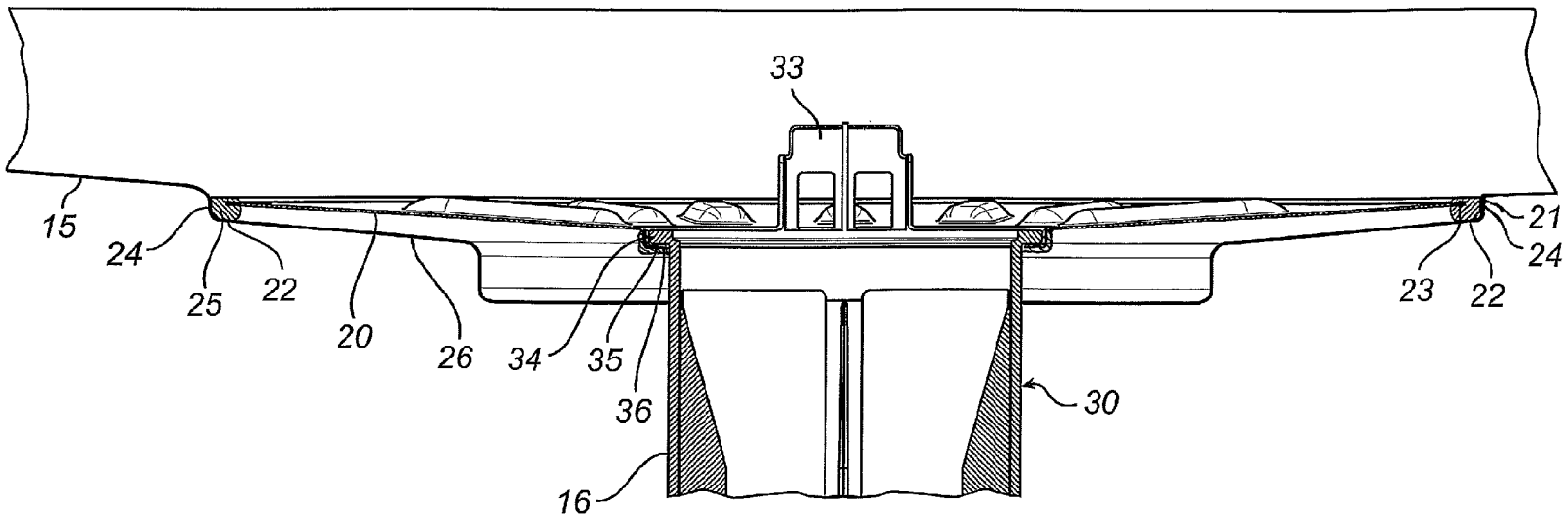
FIG. 2 illustrates a cross sectional view through the lower part of the washing chamber, the filter and the central filter unit.

The water filtering system comprises a filter 20 arranged substantially horizontal in the tub 15, and a central filter unit 30 that is removably arranged in the lower part of the washing chamber, illustrated in FIG. 2. The filter 20 is substantially flat and surrounded by an outer periphery 21 shaped like a flat rim 23 covered by a layer 25 of elastic material. The layer of elastic material is either applied on the flat rim 23 or extending around the outer periphery 21 and continues also on the opposite side of the flat rim.

The filter is supported around its outer periphery by a contact surface 22 of a recess 24 arranged in the tub 15. The recess 24 and the contact surface 22 have a shape corresponding to the peripheral shape of the filter 20 and are arranged in a plane substantially horizontal and parallel to the plane of the outer periphery 21 of the filter 20. Below the recess, a conical section 26 extends downwards towards a sump 16 in the bottom of the washing chamber 11. From the sump 16 the filtered water is directed towards a not illustrated pump and connecting tubes to different nozzles in the washing chamber. The specific design of the sump is not illustrated in the figures and could differ depending on the size and use of the dishwasher. The collected particles are collected in the sump separate from the filtered water that is lead to a pump for transport to the different nozzles.

Figure 3:
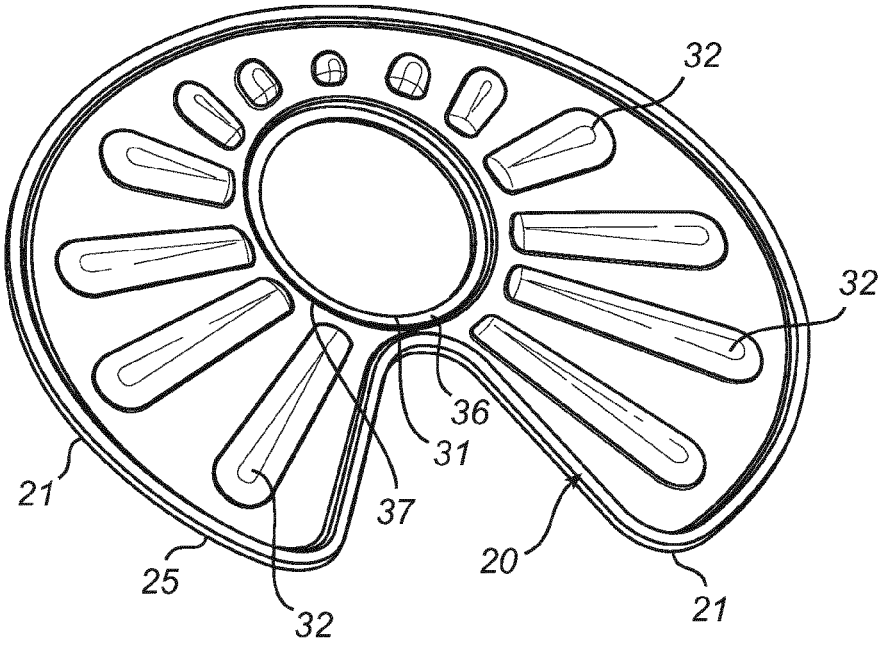
FIG. 3 illustrates a perspective view of the filter.

One embodiment of the filter 20, illustrated in perspective in FIG. 3, is substantially circular except for a sector of about 80 degrees that is left out in order to make room for a not illustrated connection for a rotating arm that is used for spraying water in the washing chamber. The filter furthermore comprises an opening 31 for the central filter unit 30 that extend in a substantially vertical direction through the filter opening 31 and further down into the sump 16. In this embodiment, the opening 31 is substantially circular and shaped like a flat rim. The central filter unit 30 has a corresponding circular cross section in order to fit in the opening. The shape of the opening and the cross sectional shape of the central filter unit could differ in any way as long as they fit together.

The filter 20 is substantially flat but provided with a number of elevations 32 that increase the stiffness of the flat filter and prevent the filter from curving and/or deforming which would lead to increased risk for water bypassing the filter. The overall size of the filter is adapted to ensure the desired filtering capacity for the specific dishwasher it is intended to be fitted in which means that the filter area is normally designed to have a considerably large size to ensure the desired filter capacity even though parts of the filter after use may be blocked by collected particles and dirt that are clogging the filter. Furthermore, the illustrated embodiment of the filter is made entirely of a filtering material in order to maximize the filter area but the filtering material could also be arranged at selected areas of the filter. The filter 20 is made either of sheet-metal or a plastic material that is able to withstand the changing temperatures in the washing chamber 11 without deforming.

In order to achieve a durable sealing between the outer periphery of the filter 20 and the contact surface 22 of the recess 24 the layer of elastic material 25 is applied on the flat rim 23 of the outer periphery 21 of the filter 20. The layer 25 of elastic material has a shape corresponding to the shape of the recess 24. In this embodiment the lower side of the filter periphery 21 is substantially flat and horizontal while the layer 25 of elastic material is extending around the outer periphery of the filter and ends on the top side of the flat rim 23. The lower horizontal side of the layer 25 of elastic material is in contact with the contact surface 22 of the recess 24 to provide the desired sealing between the filter 20 and the recess 24. Preferably also the part of the elastic layer 25 extending around the outer periphery of the filter is in contact with the vertical part of the recess 24 in order to achieve a durable and reliable sealing between the filter periphery and the recess and avoid that that dirt is stored within the gap between the vertical part of the recess and the filter outer periphery that otherwise would be the case.

The central filter unit 30 is substantially cylindrical and arranged in the opening 31 in the filter 20. The central filter unit 30 has cross sectional shape corresponding to the shape of the opening in the filter. The central filter unit extend downwards from the filter substantially vertical towards the lower section of the sump 16 and comprises passages for the water as well as for the collected waste material, not illustrated in the figures. The filter unit furthermore comprises a handle 33 arranged on the top side of the filter. The handle 33 is used to facilitate the securing and releasing of the central filter unit from the sump. The central filter unit could be secured in the sump in different ways, for example by providing the lower part of the filter unit with threads and arrange corresponding treads in the sump so that the central filter unit could be secured/released from the sump by turning of the central filter unit. Alternatively a bayonet fitting arrangement could be used to achieve the desired securing of the central filter unit and the filter.

The central filter unit is furthermore provided with a flange 34 extending in substantially radial direction from the cylindrical central filter unit. The flange 34 is positioned above the filter in such a way that a substantially flat horizontal surface 35 on the lower side of the flange 34 is in contact with the upper side 36 of the inner periphery of the filter and, when the central filter unit is turned in the direction that moves the central filter unit towards the secured position, pressing the filter 20 downwards towards the sump thereby securing both the filter and the central filter unit in the lower part of the washing chamber and provide the desired force that is required to seal both the outer and the inner periphery of the filter. The central filter unit, as well as the filter, are released from the washing chamber by turning the central filter unit in the opposite direction.

Figure 4:
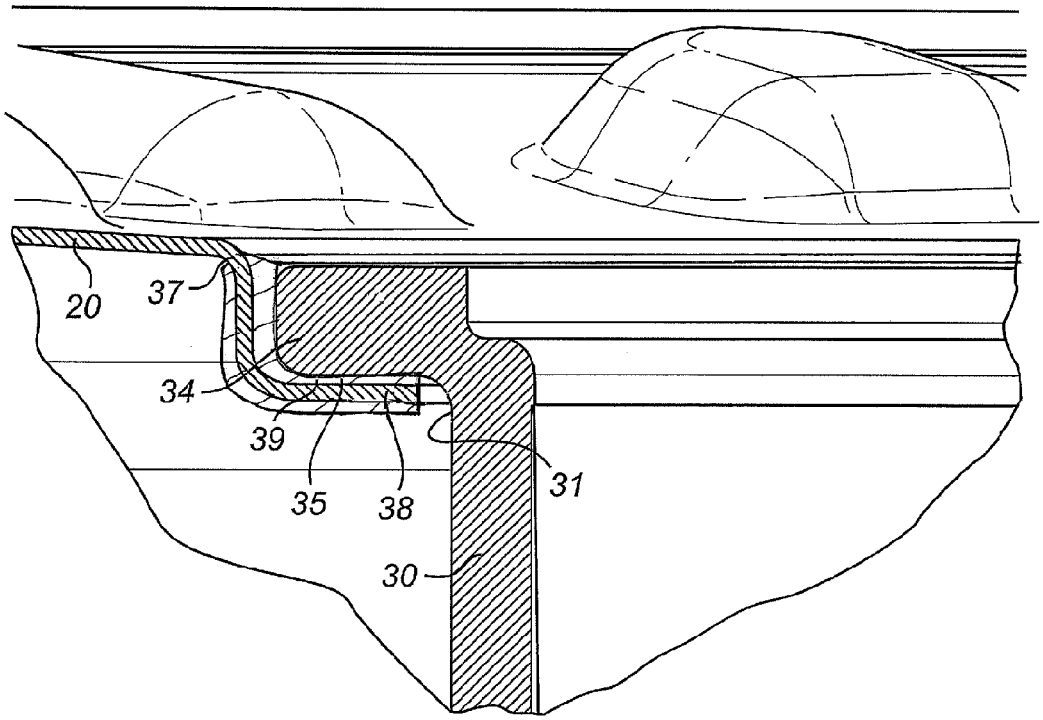
FIG. 4 illustrates an enlarged view of selected parts of the filter and central filter unit.

In order to further facilitate the correct positioning of the filter in relation the central filter unit, a shoulder 37 is surrounding the inner periphery of the filter on the upper side of the filter 20. The shoulder 37 is positioned outside the inner periphery of the filter at a distance from the inner periphery of the filter that is equal to, or slightly larger than, the radial length of the flange 34 from the central filter unit 30. This means that the filter 20 and the central filter unit 30, once the central filter unit is introduced in the opening 31, will be correctly positioned in relation to each other which is favourable in order to ensure a reliable sealing around both the outer and inner periphery of the filter. The inner periphery of the filter is shaped like a horizontal flat rim 38. In order to increase the stiffness of the filter inner periphery, the edge of the rim 38 could be folded downwards and outwards to a position where the folded edged would be arranged substantially parallel to the flat rim 38 in contact with the lower side of the flat rim. It is however, an advantage from manufacturing point of view to have a flat rim 38. The flange 34 and the inner periphery could be modified in many different ways, but the described embodiment of the filter and inner periphery are illustrated in FIG. 4.

In order to avoid water bypassing the filter via the opening 31 in the filter 20, the flat rim 38 around the opening 31 of the filter 20 is covered by a second layer 39 of elastic material. The second layer 39 of elastic material is pressed against the surface 35 on the lower side of the flange 34 and provides the desired sealing between the opening 31 in the filter and the central filter unit 30.

The layers 25, 39 of elastic material is either moulded on to the flat rims 23, 38 or glued to the rims, and the elastic material could for example be a plastic or rubber material with the desired elastic and sealing features that is resistant to water and the detergents used in dishwashers. In order to facilitate and strengthen the bounding of the elastic layer to the flat rims, the flat rims could be provided with openings or cut out portions. The elastic layer should have a thickness of about 1-6 mm in order to ensure the desired sealing properties between the contact surface of recess and the outer periphery of the filter as well as between the contact surface of the flange and the inner periphery of the filter.

In the embodiment disclosed above, the elastic material is applied on the outer and inner periphery of the filter which is very favourable since both elastic layers are arranged on the same component. The elastic material could however alternatively be applied on the contact surface of the recess in the lower part of the washing chamber, or the surface on the flange of the central filter unit. This modified dishwasher, filter and central filter unit would achieve the same beneficial effects regarding the reduced risk for water bypassing the filter.

The different embodiments described above could all be combined in different ways without departing from the scope of the invention that is defined by the appended claims.

The invention claimed is:

1. A dishwasher comprising a washing chamber and a water filtering system arranged in the lower part of the washing chamber, said water filtering system comprises a filter and a central filter unit that are removably arranged in said washing chamber, said filter has a substantially flat shape and is supported around its outer periphery by a contact surface of a recess in the lower part of the washing chamber and is secured in the washing chamber by the central filter unit, said unit being arranged in an opening in the filter and comprising a surface pressing on the inner periphery of the opening in the filter to secure the filter in the intended position, wherein at least one of said outer periphery of the filter and said contact surface of the recess, and at least one of said surface of the central filter unit and the inner periphery of the filter extending around the opening are covered by a layer of elastic material, wherein the outer periphery of the filter and the inner periphery of the filter extending around the opening are shaped like flat rims, and wherein the outer periphery of the filter is flat in a radial direction of the filter, such that an upper surface of the outer periphery of the filter is collinear with an upper surface of the substantially flat shape of the filter in the radial direction.

2. The dishwasher according to claim 1, wherein the flat rims of the outer periphery of the filter and the inner periphery extending around the opening are covered by the layer of elastic material.

3. The dishwasher according to claim 1, wherein openings are arranged in the flat rims covered by the elastic material.

4. The dishwasher according to claim 1, wherein a cross sectional shape of the layer of elastic material has a shape and size such that there are no gaps between at least one of the filter and the recess and the filter and the central filter unit.

5. The dishwasher according to claim 1, wherein the opening in the filter has a substantially circular shape with a diameter substantially corresponding to the diameter of the central filter unit.

6. The dishwasher according to claim 1, wherein the layer of elastic material is molded onto the outer periphery of the filter and onto the inner periphery of the filter extending around the opening.

7. The dishwasher according to claim 2, wherein the contact surface of the recess in the lower part of the washing chamber defines a vertical part of the recess, wherein the vertical part of the recess defines a vertically extending surface relative to the washing chamber and wherein the elastic material around the outer periphery of the filter contacts the vertical part in order to achieve a durable and reliable sealing between the outer periphery of the filter and the recess and avoid storage of dirt in a gap formed between the outer periphery of the filter and the vertical part of the recess.

8. The dishwasher according to claim 1, wherein a lower surface of the outer periphery of the filter is collinear with a lower surface of the substantially flat shape of the filter in the radial direction.

9. The dishwasher according to claim 1, wherein the layer of elastic material defines a slot parallel to the substantially flat shape of the filter, wherein the outer periphery of the filter is disposed in the slot.

10. The dishwasher according to claim 1, wherein the layer of elastic material is disposed on the upper surface of the outer periphery of the filter and a lower surface of the outer periphery of the filter.

* * * * *